US011047032B2

(12) United States Patent
Morasch et al.

(10) Patent No.: US 11,047,032 B2
(45) Date of Patent: Jun. 29, 2021

(54) METHOD FOR SOLUTION HEAT TREATING WITH PRESSURE

(71) Applicant: Brunswick Corporation, Lake Forest, IL (US)

(72) Inventors: Kevin R. Morasch, Fond du Lac, WI (US); Kevin R. Anderson, Fond du Lac, WI (US); Raymond J. Donahue, Fond du Lac, WI (US); Christopher J. Misorski, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 817 days.

(21) Appl. No.: 15/389,989

(22) Filed: Dec. 23, 2016

(65) Prior Publication Data

US 2018/0080108 A1 Mar. 22, 2018

Related U.S. Application Data

(63) Continuation-in-part of application No. 13/786,034, filed on Mar. 5, 2013, now abandoned.

(51) Int. Cl.

| | |
|---|---|
| ***C22F 1/04*** | (2006.01) |
| ***B22D 17/00*** | (2006.01) |
| ***B22D 21/00*** | (2006.01) |

(52) U.S. Cl.

CPC ..... *C22F 1/04* (2013.01); *B22D 17/00* (2013.01); *B22D 21/007* (2013.01)

(58) Field of Classification Search

CPC ..... C22F 1/04; C22C 21/00
USPC ..... 148/549, 559, 688, 698, 666, 705, 706
See application file for complete search history.

(56) References Cited

U.S. PATENT DOCUMENTS

| | | | |
|---|---|---|---|
| 3,732,128 | A | 5/1973 | Statham |
| 4,854,368 | A | 8/1989 | Vezirian |
| 5,014,764 | A | 5/1991 | Garat |
| 5,058,653 | A | 10/1991 | Garat |
| 5,088,544 | A | 2/1992 | Garat |
| 5,161,595 | A | 11/1992 | Garat |

(Continued)

FOREIGN PATENT DOCUMENTS

WO 2006/066314 6/2006

OTHER PUBLICATIONS

"Heat Treatment of Aluminum Casting Alloys for Vacuum Die Casting," Light Metal Age, Schneider and Feikus, 1998.

(Continued)

*Primary Examiner* — Jenny R Wu
(74) *Attorney, Agent, or Firm* — Andrus Intellectual Property Law, LLP

(57) ABSTRACT

A method of heat treating high pressure die cast objects using pressure is disclosed. A high pressure die cast object is obtained and solution heat treated to above 700° F. for at least 2 hours at pressures between 0.5 and 35 KSI or at any pressure or range of pressures therebetween. This method of solution heat treatment with pressure reduces and/or eliminates blistered defects on the high pressure die cast object. The method of heat treating by solution heat treatment with pressure also allows an increase of yield strength and corresponding weight reduction upon redesign or substantially larger safety factors for the cast object.

14 Claims, 10 Drawing Sheets
(9 of 10 Drawing Sheet(s) Filed in Color)

(56) References Cited

U.S. PATENT DOCUMENTS

| | | | | |
|---|---|---|---|---|
| 5,862,976 | A * | 1/1999 | Yamamoto | B23K 35/282 228/224 |
| 5,957,188 | A | 9/1999 | Crafton | |
| 5,960,851 | A | 10/1999 | Donahue | |
| 6,042,369 | A | 3/2000 | Bergman et al. | |
| 6,524,409 | B2 | 2/2003 | Barone et al. | |
| 6,857,685 | B2 | 2/2005 | Wagner | |
| 6,921,512 | B2 | 7/2005 | Doty | |
| 7,494,554 | B1 | 2/2009 | Donahue et al. | |
| 2004/0011437 | A1 | 1/2004 | Lin et al. | |
| 2011/0061771 | A1 | 3/2011 | Trietler et al. | |
| 2012/0261034 | A1 | 10/2012 | Lin et al. | |

OTHER PUBLICATIONS

"Solution Heat Treatment for AlSiMg Foundry Alloys," Liss Pederson, Apr. 1999.

"Short Term Solution Heat Treating—The Industrial Application," Ray Donahue, 2001.

"Hot Isostatic Pressing of Aluminum Alloy Castings," S.J. Vonk et al, Feb. 1981.

R. Lumley et al., Heat Treatment of High-Pressure Die Castings, Metallurgical and Materials Transactions, vol. 38A, Aug. 29, 2010, pp. 2564-2574, XP002780814, AU.

A. Rose et al., Quenching Distortion of Aluminum Castings—Improvement by Gas Cooling, MAT.-WISS. U Werkstofftech., vol. 37, No. 1, Dec. 30, 2006, pp. 116-121, CP002780815, DE.

Dr. K. Kulkarni, Heat Treatments of Aluminum Alloys, IIT Kanpur, Oct. 21, 2015, pp. 1-17, XP002780816, Kanpur, India, retrieved from Internet: https://www.iitk.ac.in/tkic.

European Search Report, EP Patent Application No. 17206338.0, date of completion May 7, 2018.

* cited by examiner

Very small blister (~ 1mm diameter) at the root of a propeller blade processed at 2.3 ksi.

METHOD FOR SOLUTION HEAT TREATING WITH PRESSURE

CROSS REFERENCE TO RELATED APPLICATION

This application is a continuation-in-part of U.S. patent application Ser. No. 13/786,034, filed Mar. 5, 2013, which is incorporated herein by reference in entirety.

FIELD

The present application relates to heat treatment of high pressure die cast objects, and more particularly to the solution heat treatment of high pressure die cast objects with pressure.

BACKGROUND & SUMMARY

High pressure die casting is a low cost, dimensionally accurate casting process for high volume production of many cast objects, including, but not limited to marine propellers, marine and automotive engine components, vehicle chassis, vehicle closures, vehicle structural bodies, and advanced vehicle bodies. Approximately 70% of all cast aluminum is cast using the high pressure die casting process, primarily using aluminum alloys. In high volume, the high pressure die casting process delivers castings on a cost per pound basis that are lower cost at higher dimensional accuracy than alternative methods such as permanent mold casting or sand casting.

The disadvantage of the high pressure die casting process is that it results in cast objects having comparatively lower strength than permanent mold or sand casting. This lower strength is due to the fact that the high pressure die casting process moves metal in a violent, turbulent fashion, entrapping air in the molten metal during the casting process. This entrapped air becomes problematic because, in order to increase the strength of a high pressure aluminum die cast object, it is preferable to heat treat the cast object after casting. A typical heat treatment to strengthen aluminum alloys is solution heat treatment and artificial aging to achieve the T6 treatment condition. However, heat treatments above 700° F. are not used for increasing the strength and ductility of high pressure die cast objects because often the air entrained or entrapped in the castings expands during the solution heat treatment at temperatures above 700° F., creating blisters on and in the cast product. The blisters cause aesthetic issues with surface finish and create large pores that reduce the mechanical properties of the casting. Therefore, conventional high pressure die castings are used in the "as cast" condition. For many low copper content alloys like Aluminum Association alloys 367, 360, or 361 the associated yield strength is about 17 KSI, in the "as cast" condition.

In traditional solution heat treatment, the cast object is placed in an air furnace, fused salt bath, or fluidized sand bed and manipulated with heat to develop a wide range of mechanical properties and achieve a combination of properties unattainable by other means. The high pressure die cast object is heated to a specific temperature to create a super-saturated solution of alloy elements, and the object is then soaked at that temperature for a given time. Subsequently, the die cast object is rapidly quenched and artificially aged at a lower temperature for a given period of time.

During the solution heat treatment portion of the T6 heat treating process, cast objects may be subjected to temperatures up to 1000° for up to 12 hours. At 1000° F. a permanent mold or sand cast aluminum alloy cast object will dissolve any magnesium present into solid solution for the given alloy, and will thermally modify the eutectic silicon providing mechanical advantages. Again however, when high pressure die cast objects are subjected to T6 heat treatment conditions, any entrained gas in the casting will volumetrically expand at the increased temperature, increasing the pressure within the pore or defect. This increase in pressure and the result of low mechanical properties of the metal at that elevated temperature creates a situation where the metal plastically deforms leaving a blister defect either internally or at the surface that creates aesthetic and mechanical problems. Prior to the present application, blister defects were prevented by heat treating high pressure die cast objects at very short solution times (e.g. 15 minutes). This short solution time fails to allow for sufficient modification of the eutectic and does not create the mechanical advantages that a longer (e.g. 2-12 hour) treatment creates.

It remains highly desirable to conduct heat treatment of high pressure die cast objects because the heat treatment generally doubles the yield strength. For example, a T6 heat treatment of an aluminum alloy high pressure die cast object will increase from 17 KSI in the "as cast" condition to approximately 35 KSI in the T6 heat treated condition, if no blistering defects arise to impair the mechanical properties. Moreover, this dramatic increase in strength will allow a design engineer to redesign a part that typically achieves a 30% reduction in the weight of the part when considering multiple modes of loading and part geometries.

It is known in the art to apply pressure to objects cast using the sand casting or permanent mold casting processes through hot isostatic pressing or HIP. The HIP process involves healing of shrinkage porosity and subsequent improvements in tensile and fatigue properties for sand cast or permanent mold cast aluminum castings. Internal shrinkage porosity results from solidification shrinkage of the alloy and processing variables such as the geometric effects of the mold, or the effects of casting parameters including metal temperature, mold temperature, cooling rate, and pour rate. The HIP procedure involves the use of uniform gas pressure applied at elevated temperatures and subsequent slow cooling to room temperature. The parts are commonly solution heat treated after cooling to room temperature. In the case of aluminum alloys, pressures above 15 KSI and temperatures around 980° F. can be used. The applied pressure causes plastic flow in the material and the resulted healing of shrinkage porosities, however, in the HIP process, it is well known that pressures of 10 KSI or less are inadequate for full densification of the material within the time and temperature of limitations for the HIP process. Accordingly, a pressure of 15 KSI or greater is generally required to realize the advantages of the HIP process.

There are several problems with using the hot isostatic pressing process with high pressure die cast objects. First, the high pressure die casting process requires high pressures, above 15 KSI, and large, expensive pressure vessels to attain that pressure. More significantly, the hot isostatic pressing process is incapable of fixing blistering defects resulting from the high pressure die casting process. In other words, the extensive amount of entrapped air in high pressure die cast aluminum alloy castings cannot be fixed by the hot isostatic pressing process. This well-known lack of effectiveness of HIP processing on high pressure die castings was verified by the inventors in an experiment where a high pressure die cast propeller was subjected to 15 KSI pressure at 1000° F. for 4 hours of hot isostatic pressing and allowed to cool to room temperature. The same propeller was then heat treated at 1000 F for 4 hours at atmospheric conditions. Blistering defects were still evident after the process showing that the internal defects in the casting were not healed by the HIP process as shown in FIGS. 9A and 9B.

Thus, it is known that the hot isostatic pressing (HIP) process is incapable of curing blistering defects from subsequent solution heat treatment of cast objects, particularly aluminum alloy cast objects. In accordance with the present application, it has been surprisingly found that the application of pressure during the solution heat treatment process, at pressures below conventional hot isostatic pressing (HIP) pressures, results in a beneficial pressure equilibrium within an "as cast" high pressure die cast object where air entrained in the casting due to the high pressure die casting process cannot expand and form blistering defects. Accordingly, the present application discloses an application of external pressure during solution heat treatment of a high pressure die cast object to inhibit the problematic blistering defects that occur during a traditional heat treatment of a high pressure die cast object. The present application discloses a method of heat treating a high pressure die cast object. The method includes obtaining a high pressure die cast object, and solution heat treating the high pressure die cast object above 700° F. for 0.5 to 12 hours at a pressure between 0.5 and 35 KSI. Subsequently, the cast object may be quenched and artificially aged to create a high pressure die cast object without blistering defects. The pressure applied during the solution heat treatment step of one embodiment is between 0.5 and 15 KSI or at any pressure or range of pressures therebetween. Another embodiment of the external pressure applied during the solution heat treatment step is between 2.5 and 10 KSI or at any pressure or range of pressures therebetween; while in another embodiment the pressure applied is between 2.5 and 5 KSI or at any pressure or range of pressures therebetween. The use of external pressure above 2.5 KSI creates a pressure balance during the heat treatment of the high pressure die cast object such that air cannot expand to cause the problematic blistering on the final heat treated object. The use of external pressure between 0.5 and 3.5 KSI is sufficient to reduce and/or eliminate blistering defects.

In one embodiment, the step of solution heat treating comprises a T6 heat treatment with the application of pressure between 0.5 and 15 KSI, 0.5 and 10 KSI or 2.5 to 5 KSI, or at any pressure or range of pressures between 0.5 and 15 KSI. In another embodiment, the solution heat treatment temperature is between 700° F. and 1200° F., or at any temperature or range of temperatures therebetween. In another embodiment, the temperature is between 800° F. and 1000° F., or at any temperature or range of temperatures therebetween. In another embodiment, the solution heat treatment temperature is at 1000° F. In one embodiment, the solution heat treatment step is 0.5 to 12 hours; in another embodiment, the time is 2 to 8 hours; while in yet another embodiment, the solution heat treatment time with pressure is 4 to 6 hours. It will be recognized that such ranges are exemplary, and the range of time may be at any time within the ranges noted.

The method of heat treating may further include the step of quenching the cast object. The method of heat treating may also include a step of artificially aging the cast object. The step of quenching will typically occur immediately after the cast object is removed from the solution heat treatment pressure vessel. Allowing the cast object to slowly cool to room temperature without cooling is not desirable since the beneficial effects to the microstructure from solution heat treatment may be lost.

The present application also contemplates a method of heat treating a high pressure die cast aluminum alloy object. This method includes casting an aluminum alloy object with high pressure die cast equipment and removing the cast aluminum alloy object from the high pressure die casting equipment. The cast aluminum alloy object is then placed into a pressure vessel, the pressure vessel including a heating element. The cast aluminum alloy object is solution heat treated above 700° F. while applying pressure between 0.5 and 35 KSI or 0.5 to 12 hours. The solution heat treated cast object is removed from the pressure vessel. In this method, the step of solution heat treating reduces blistering defects on the final cast of aluminum alloy object.

In a further embodiment, the step of solution heat treating comprises a T6 heat treatment while applying pressure between 0.5 and 15 KSI or at any pressure or range of pressures therebetween. In another embodiment, the step of solution heat treating comprises solution heat treating the cast aluminum alloy object between 700° F. and 1200° F. or at any temperature or range of temperatures therebetween. In yet another embodiment, the step of solution heat treating comprises solution heat treating the cast aluminum alloy object at 1000° F. In still another embodiment, the step of solution heat treating comprises applying pressure between 0.5 and 15 KSI, or at any pressure or range of pressures therebetween. In another embodiment, the step of solution heat treating comprises applying pressure between 2.5 and 10 KSI or at any pressure or range of pressures therebetween, wherein the step of solution heat treating eliminates blistering defects on the final cast aluminum alloy object. In yet another embodiment, the step of solution heat treating comprises applying pressure between 2.5 and 5 KSI or at any pressure or range of pressures therebetween, and wherein the step of solution heat treating eliminates blistering defects on the final cast aluminum alloy object.

The step of solution heat treating may comprise solution heat treating the cast aluminum alloy object for 2-8 hours or for any time or range of times therebetween, including, but not limited to 4-6 hours, and at 4 hours. The method of the present application further contemplates an embodiment where a method of heat treating further comprises the steps of quenching the cast aluminum alloy object and artificially aging the cast aluminum alloy object.

By employing the solution heat treatment and pressure method of the present application, it is contemplated that the yield strength of cast objects may increase by 50% to 100%. This translates into a 15-30% weight reduction on average for structural components. This weight reduction has substantial economic and societal value in terms of energy and $CO_2$ footprint reduction in automotive and other transportation applications where increasing fuel economy is paramount.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION OF THE DRAWINGS

The present application relates to a method of reducing and/or eliminating blistering defects in high pressure die cast metal objects that typically occur during the solution heat treatment of high pressure die cast objects. The present application contemplates that applying between 0.5 and 35 KSI (500 psi-35,000 psi) will reduce and/or eliminate blistering defects, and application of pressure between 2.5 and 35 KSI, or at any pressure or range of pressures therebetween, will eliminate blistering defects. In one embodiment, the application pressure is lower than the pressure applied during hot isostatic pressing, and therefore is at or below 15 KSI. In another embodiment, pressure applied that is between 2.5 and 10 KSI. In another embodiment, the pressure applied is 5 KSI. The application of pressure creates a balance with any air that may be entrained or entrapped in the high pressure die cast object due to the turbulent nature of the high pressure die casting process. By the application of pressure, any air entrained or entrapped in the casting cannot expand, and therefore blisters are reduced and/or eliminated. Accordingly, the increasing internal pressure of entrained air during solution heat treatment is offset as the casting is heated to elevated temperatures with external pressure. If the external pressure and the inherent strength of the material at elevated temperatures is greater than the internal pressure of the entrapped air, blistering will not occur.

The present application contemplates a method of heat treating a high pressure die cast object. In one embodiment, the high pressure die cast object is an aluminum alloy high pressure die cast object, however, the present application may be used for heat treating any high pressured die cast metal object wherein air becomes entrained during the turbulent high pressure die casting process. The method contemplates first obtaining a high pressure die cast object 2. In the embodiment shown in the FIGS. 2-8, the high pressure die cast object 2 is a marine propeller, however the present application is applicable for any high pressure die cast object that may be formed using the high pressure die casting method, including but not limited to, vehicle chassis, vehicle closures, structural bodies, and advanced vehicle bodies.

Figure 1:
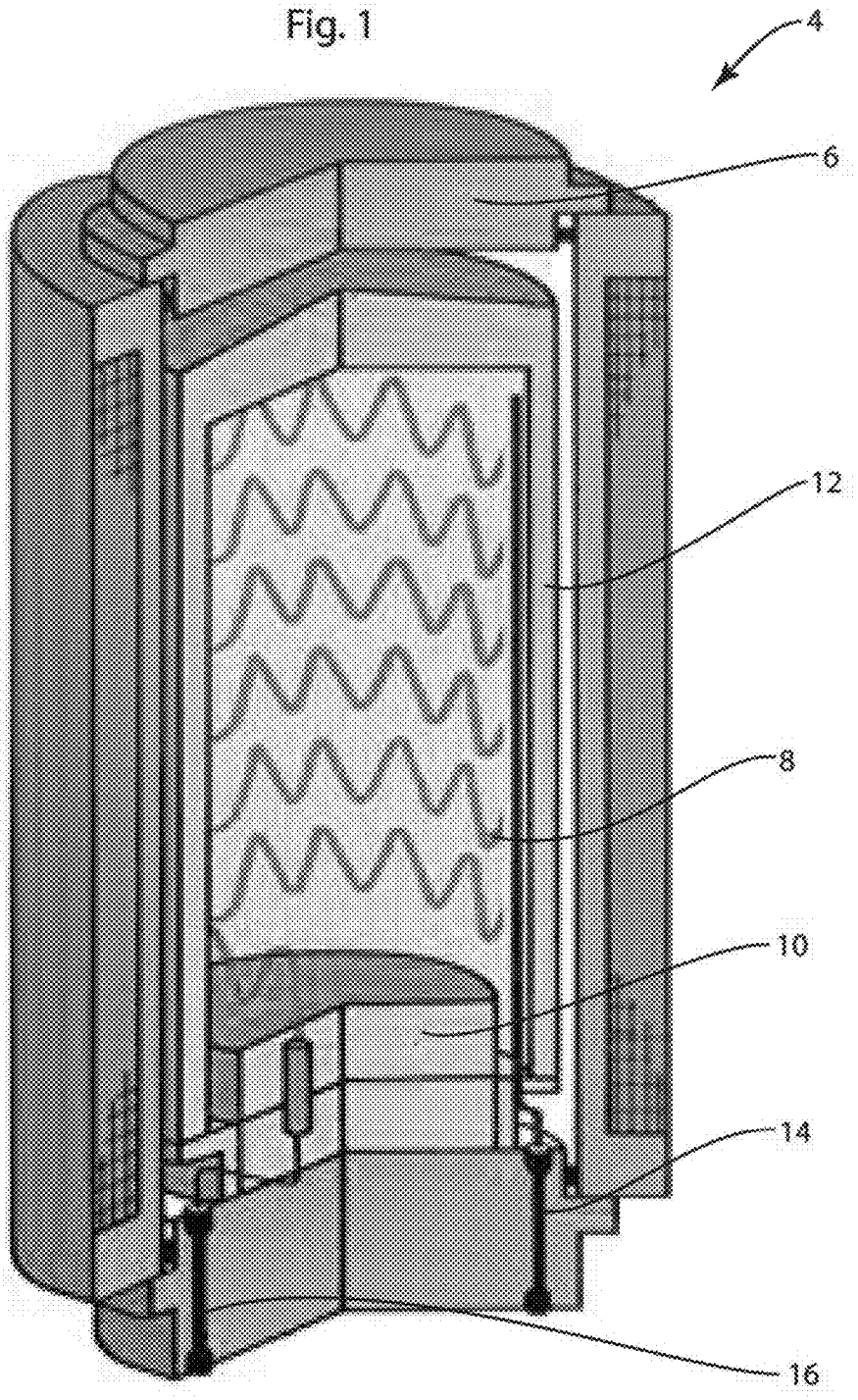
FIG. 1 is a perspective view of an exemplary pressure chamber used for the disclosed method of solution heat treating with pressure processing of the present application.

Referring now to FIG. 1, once the high pressure die cast object is obtained, the object is subjected to solution heat treatment with pressure. A pressure vessel 4 having an end closure 6, heating means such as heating elements 8 and workload support 10 may be used for the step of solution heat treating with pressure. However, the pressure vessel 4 may be any certified pressure vessel capable of applying pressure up to 35 KSI and heat up to 1200° F. In one embodiment, a certified pressure vessel capable of applying pressure up to 15 KSI is acceptable, while in other embodiments, certified vessels that have a maximum pressure of 10 KSI or 5 KSI are acceptable. Acceptable pressure vessels for solution heat treatment with pressure in accordance with the present application may be obtained from American Isostatic Presses, Inc. of Columbus, Ohio. The pressure vessel 4 may further include insulation 12 to efficiently solution heat treat the high pressure die cast object 2 at the requisite temperatures and pressures. Additionally, a thermocouple feed through 14 and power feed through 16 may be present to provide for the measurement of heat and pressure. The pressure vessel 4 is connected to a compressor (not shown) to create the necessary pressure during the solution heat treatment process.

The high pressure die cast object 2 is placed within the pressure vessel 4, and the pressure vessel 4 is sealed with end closure 6. The cast object is then solution heat treated to above 700° F. at a pressure between 0.5 and 35 KSI for 0.5 to 12 hours. In one embodiment, the temperature is between 700 and 1200° F. or at any temperature or range of temperatures therebetween. In another embodiment, the temperature is between 800 and 1000° F., in yet another embodiment, the temperature is at 1000° F. Similarly, the pressure may vary, with one embodiment applying pressure between 0.5 and 15 KSI or at any pressure or range of pressures therebetween, another embodiment applying pressure between 2.5 and 10 KSI, another embodiment applying pressure between 2.5 and 5 KSI, and an embodiment where pressure is applied at 5 KSI. In one embodiment, the time and temperature comprises a T6 heat treatment at a pressure between 0.5 and 15 KSI. In yet another embodiment, the high pressure die cast object is solution heat treated at 1000° F. for 4 hours at 5 KSI to achieve a high pressure die cast object devoid of blistering defects.

The gas used to apply pressure through the compressor may be atmospheric gas, an inert gas, or any other gas sufficient to apply the required pressures during solution heat treatment without combusting. In one embodiment, the gas is an inert gas. In another embodiment, the gas used is argon. Once the high pressure die cast is solution heat treated for the desired time, the die cast object is quenched and may optionally be artificially aged. Quenching contemplates rapidly cooling the solution heat treated object directly after removal from the solution heat treatment pressure vessel, and not allowing the object to slowly cool to room temperature. In one embodiment, the cast object is artificially aged for at least 2 hours. However, the length of time and the temperature for artificial aging is generally dictated by the strength and ductility levels desired, as is well-known by those of ordinary skill in the art.

The solution heat treatment with pressure provides for the ability to increase the yield strength of high pressure die cast objects. For example, and without limitation, the typical mechanical properties of high pressure die cast alloy A360.0 in the as cast condition for temperatures up to 700° F. are demonstrated in Table 1, below.

TABLE 1

Table 1 Typical tensile properties for separately cast test bars of alloys 360.0-F and A360.0-F at elevated temperature

| Temperature | | Tensile strength | | Yield strength(s) | | Elongation (b) |
|---|---|---|---|---|---|---|
| ° C. | F.° | MPa | ksi | MPa | ksi | % |
| 360.0 aluminum | | | | | | |
| 24 | 75 | 325 | 47 | 170 | 25 | 3 |
| 100 | 212 | 305 | 44 | 170 | 25 | 2 |
| 150 | 300 | 240 | 35 | 165 | 24 | 4 |
| 205 | 400 | 150 | 22 | 95 | 14 | 8 |
| 250 | 500 | 85 | 12 | 50 | 7.5 | 20 |
| 315 | 600 | 50 | 7 | 30 | 4.5 | 35 |
| 370 | 700 | 30 | 4.5 | 20 | 3 | 40 |
| A360.0 aluminum | | | | | | |
| 24 | 75 | 315 | 46 | 165 | 24 | 5 |
| 100 | 212 | 295 | 43 | 165 | 24 | 3 |
| 150 | 300 | 235 | 34 | 160 | 23 | 5 |
| 205 | 400 | 145 | 21 | 90 | 13 | 14 |
| 250 | 500 | 75 | 11 | 45 | 6.5 | 30 |
| 315 | 600 | 45 | 6.5 | 28 | 4 | 45 |
| 370 | 700 | 30 | 4 | 15 | 2.5 | 45 |

(a) 0.2% offset.
(b) In 50 mm or 2 in.

Figure 2:
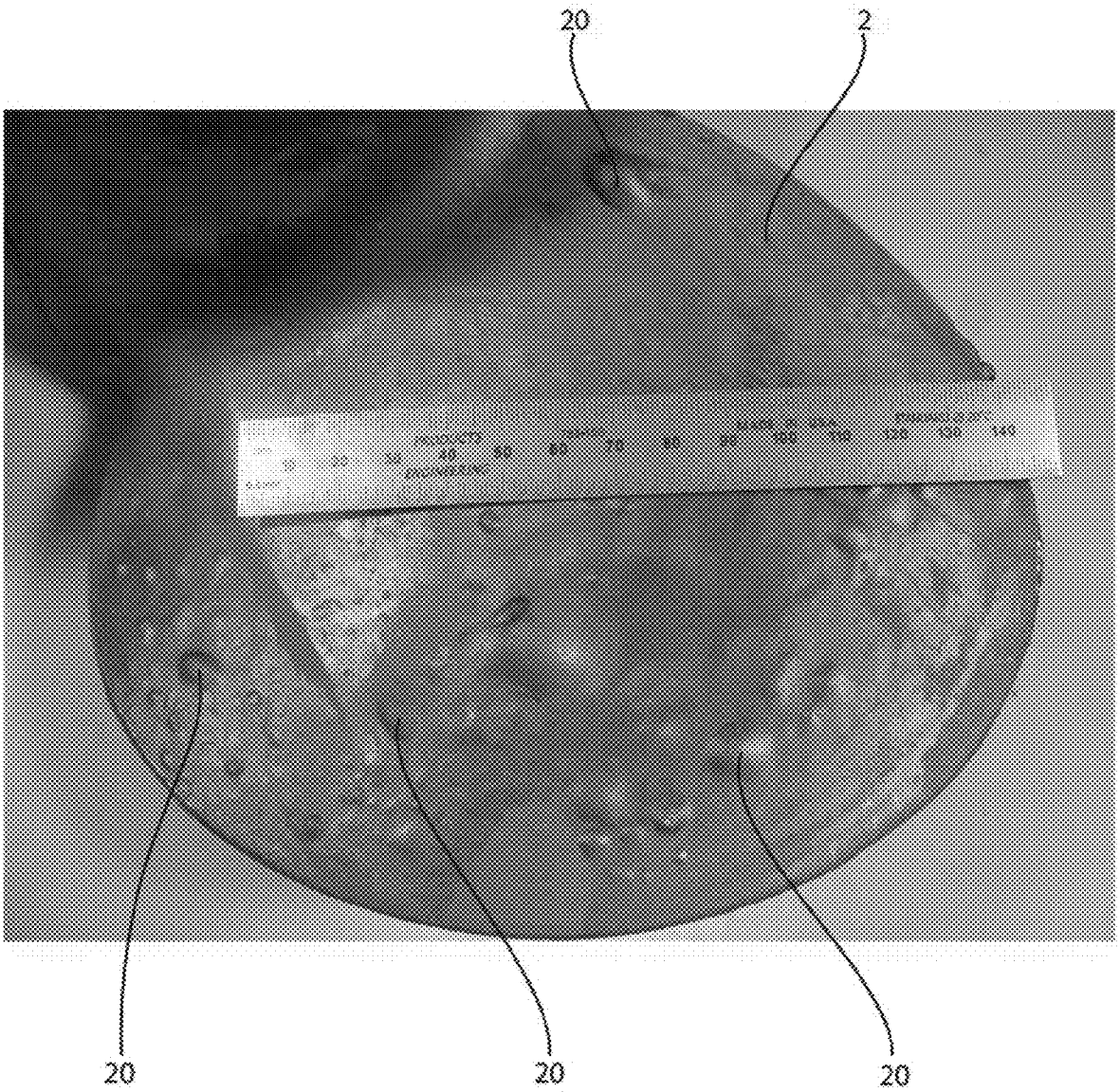
FIG. 2 is a photograph demonstrating blister defects on a solution heat treated high pressure die cast aluminum alloy propeller blade subjected to solution heat treatment at 1000° F. with no pressure applied.

According to Table 1, at higher temperatures required for solution heat treatment, i.e. above 700° F., the tensile strength will be less than 4 KSI and the yield strength will be less than 2.5 KSI. Thus, at solution heat treatment temperatures, when the yield strength of the die casting alloy is less than the pressure in the entrapped air, the air will expand, creating blistering defects 20, as shown in FIG. 2. As shown in FIGS. 5-8, 10*a* and 10*b*, by applying an external gas pressure above 2.5 KSI to the cast object, the internal trapped gas cannot expand, and therefore the blistering of the high pressure die cast object can be eliminated. Even at lower pressures from 0.5 to 3.5 KSI, blistering defects can be reduced as shown in FIGS. 3, 4, 10*a* and 10*b*. Since the blistering defects may be eliminated while obtaining the advantages of the solution heat treatment process, the yield strength of the solution heat treated high pressure die cast objects may increase by 50% to 100%. This translates into a 15-30% weight reduction on average for a redesigned component or a substantially higher safety factor on the same geometry component. It is known in the art that a 10% increase in yield strength of an aluminum casting can facilitate a designed weight reduction of 3% on average for the cast object. This is highly important, particularly in vehicle design (whether automobiles, trucks, or marine vehicles, because even a 10% total vehicle weight reduction improves mileage by 5-7%. Accordingly, the present invention provides a significant advance as weight reductions of 15-30% may be obtained.

EXAMPLES

Example 1

High pressure die cast aluminum alloy marine propellers were selected as a test sample. FIG. 2 demonstrates a high pressure die cast aluminum alloy marine propeller treated at the T6 heat treatment of 1000° F. for 4 hours with 0 KSI pressure applied. Numerous blistering defects 20 are demonstrated.

Figure 6A:
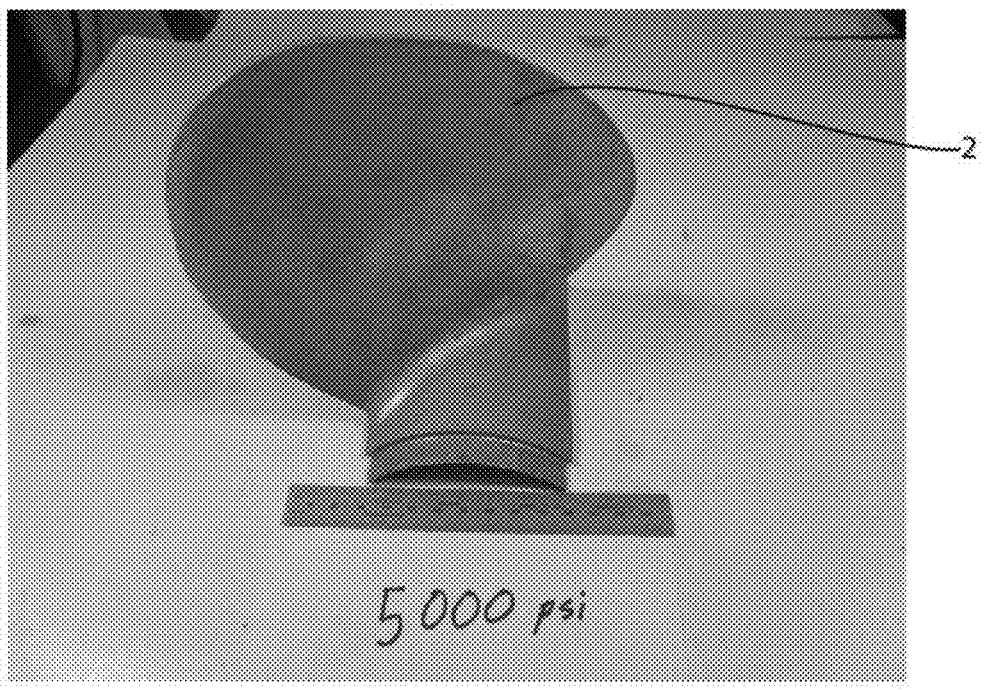
FIGS. 6*a* and 6*b* are photographs demonstrating a solution heat treated high pressure die cast aluminum alloy propeller blade where blistering defects are eliminated through the application of 5.0 KSI (5000 psi) of pressure during solution heat treatment.
Figure 6B:
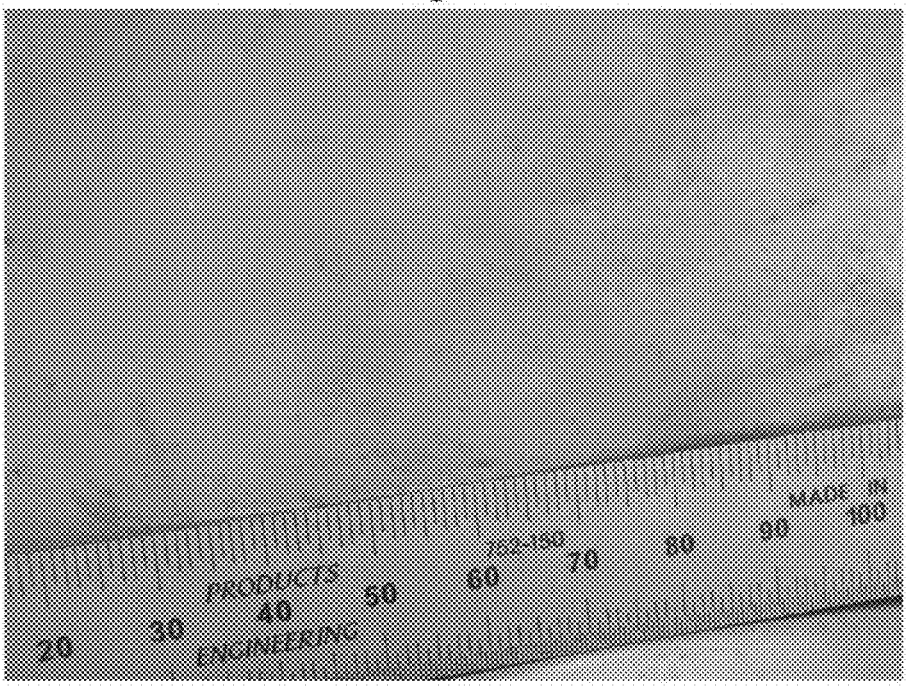
Figure 7A:
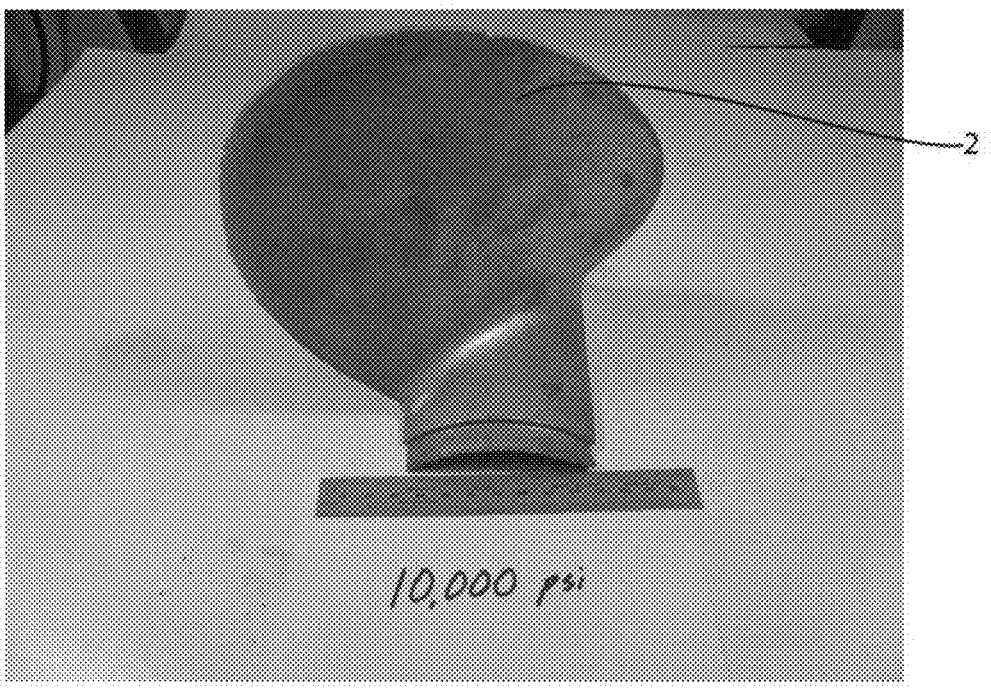
FIGS. 7*a* and 7*b* are photographs of a solution heat treated high pressure die cast aluminum alloy propeller blade demonstrating elimination of blistering defects when 10.0 KSI (10,000 psi) of pressure is applied during solution heat treatment.
Figure 7B:
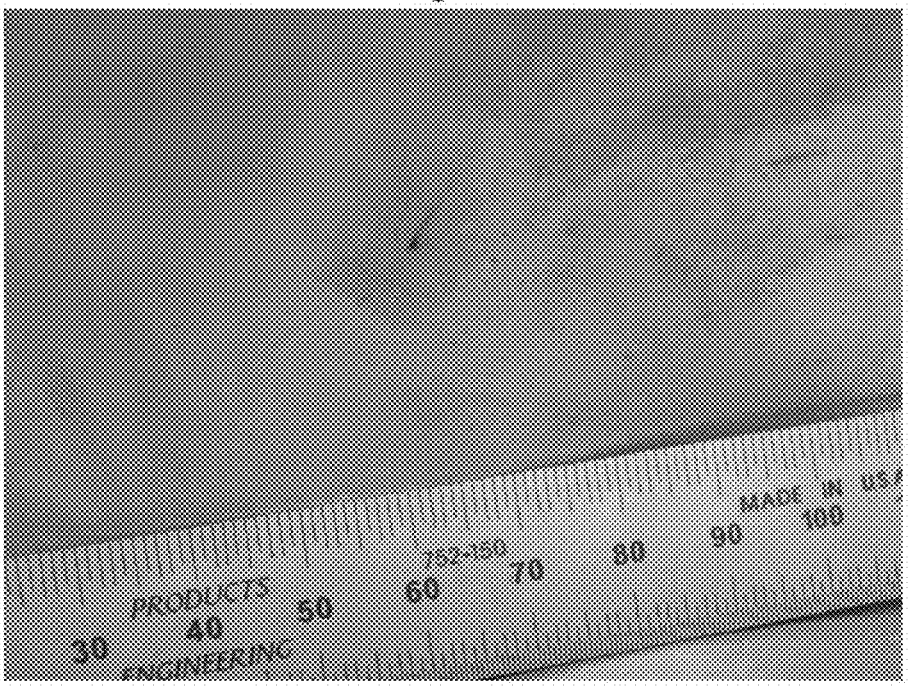
Figure 8A:
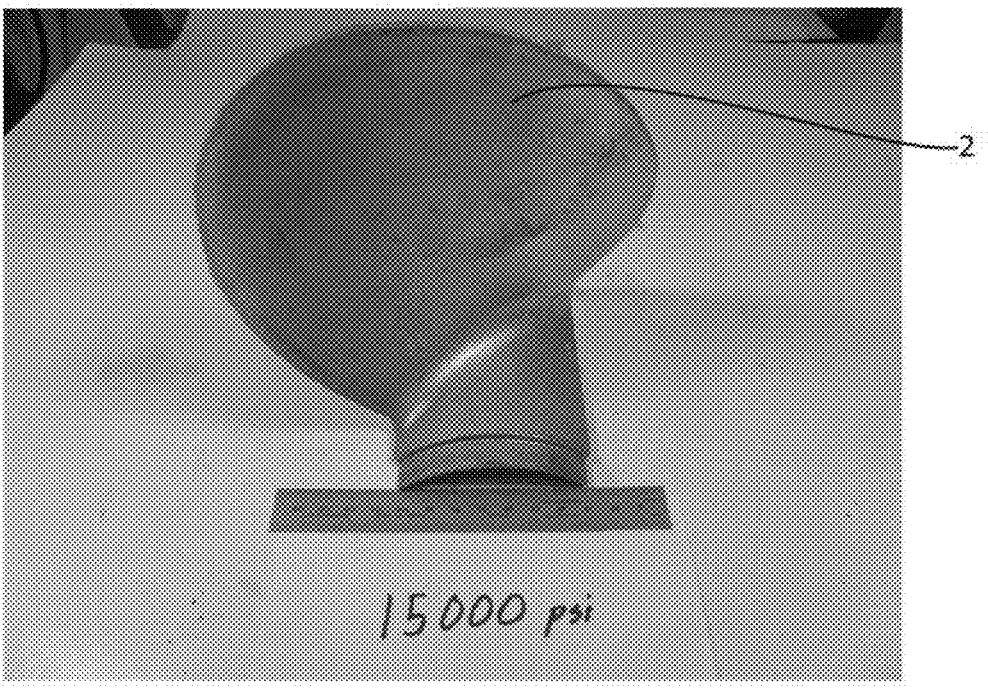
FIGS. 8*a* and 8*b* are photographs of a solution heat treated high pressure die cast aluminum alloy propeller blade demonstrating elimination of blistering defects when 15.0 KSI (15,000 psi) of pressure is applied during solution heat treatment.
Figure 8B:
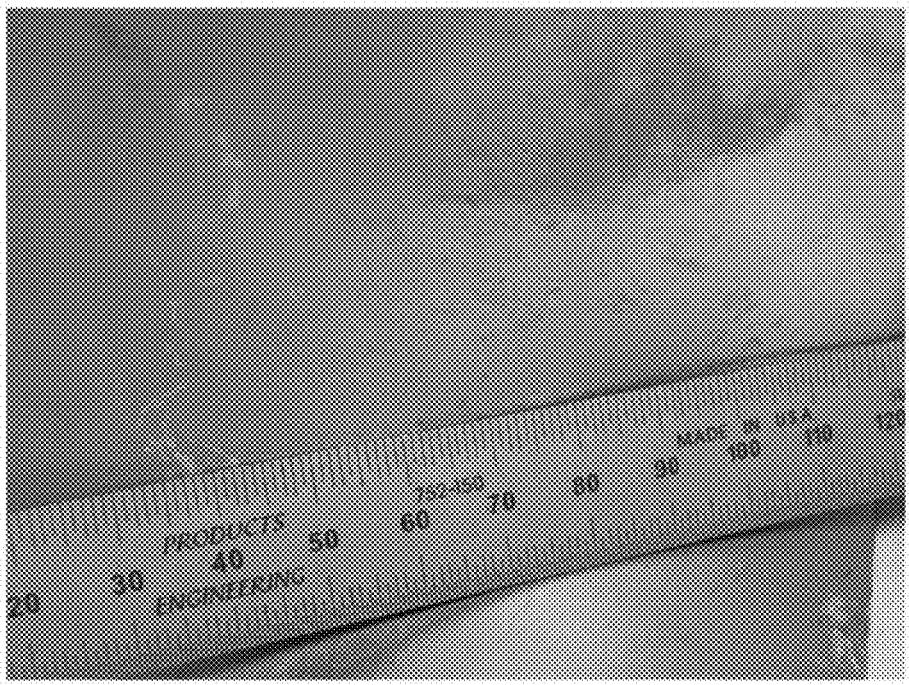

Subsequently, high pressure die cast aluminum alloy marine propellers were subjected to solution heat treatment with pressure. Eighteen (18) high pressure die cast aluminum alloy propellers were solution heat treated with an externally applied gas pressure of 15 KSI, 10 KSI and 5 KSI, respectfully (i.e. six (6) samples at each pressure). Each solution heat treatment was at 1000° F. for 4 hours. The externally applied gas pressure was accomplished through placing the high pressure die cast aluminum alloy marine propellers in a pressure vessel 4, and the pressure was applied using argon. The results are shown in FIGS. 6, 7 and 8, wherein an elimination of blister defects 20 was observed.

Example 2

Figure 3A:
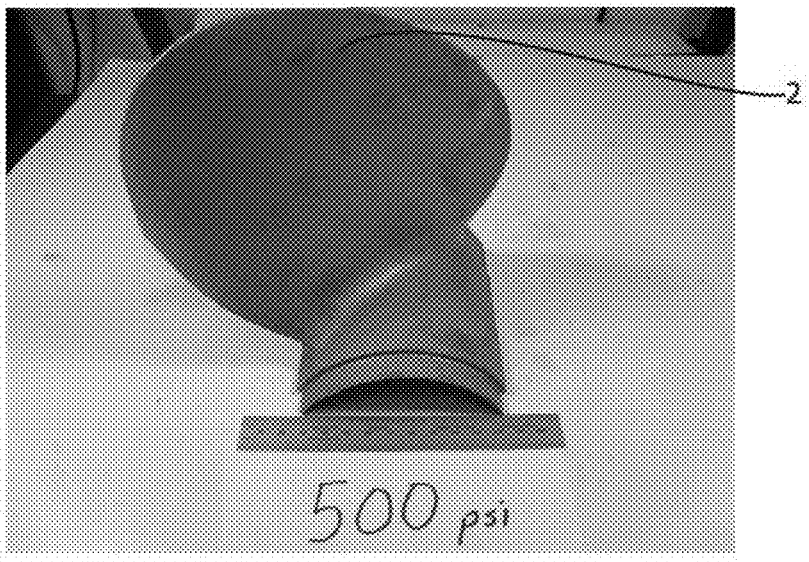
FIGS. 3*a*-3*c* are photographs of a solution heat treated high pressure die cast aluminum alloy propeller blade demonstrating reduction of blistering defects when 0.5 KSI (500 psi) of pressure is applied during solution heat treatment.
Figure 3B:
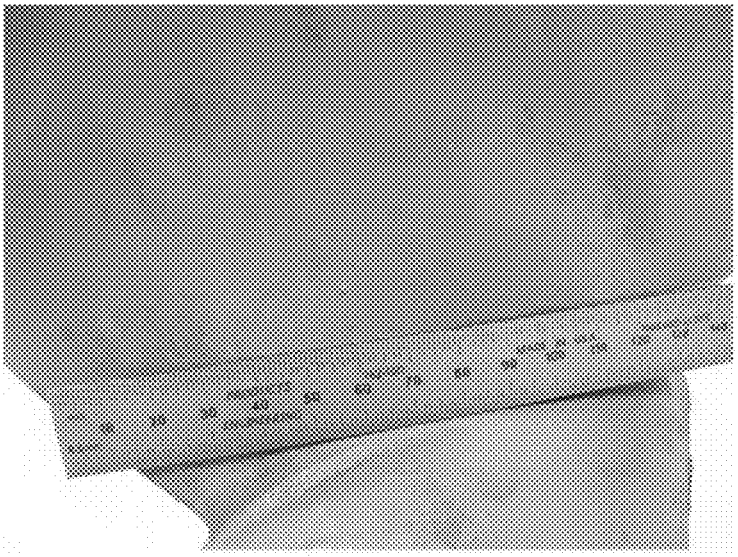
Figure 3C:
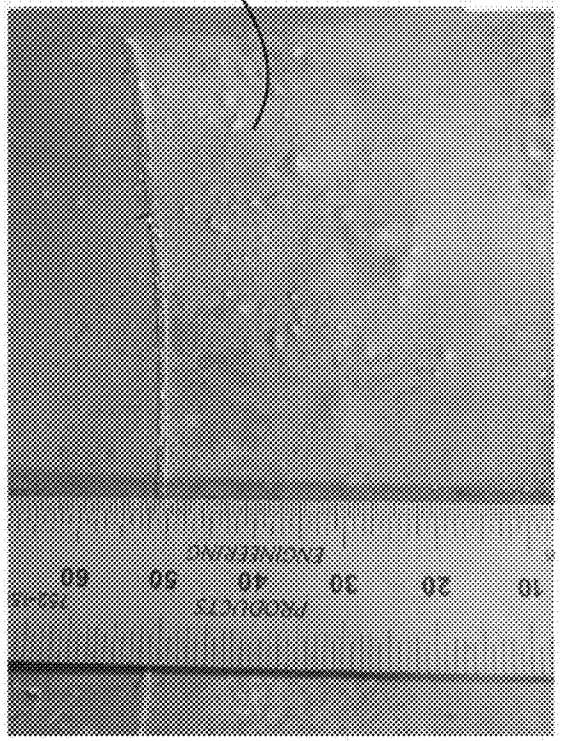
Figure 4A:
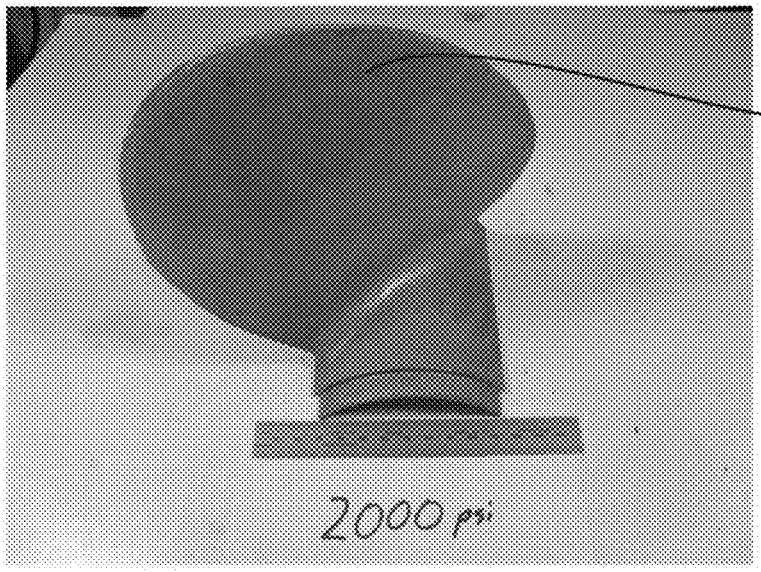
FIGS. 4*a*-4*c* are photographs of a solution heat treated high pressure die cast aluminum alloy propeller blade demonstrating reduction of blistering defects when 2.0 KSI (2000 psi) of pressure is applied during solution heat treatment.
Figure 4B:
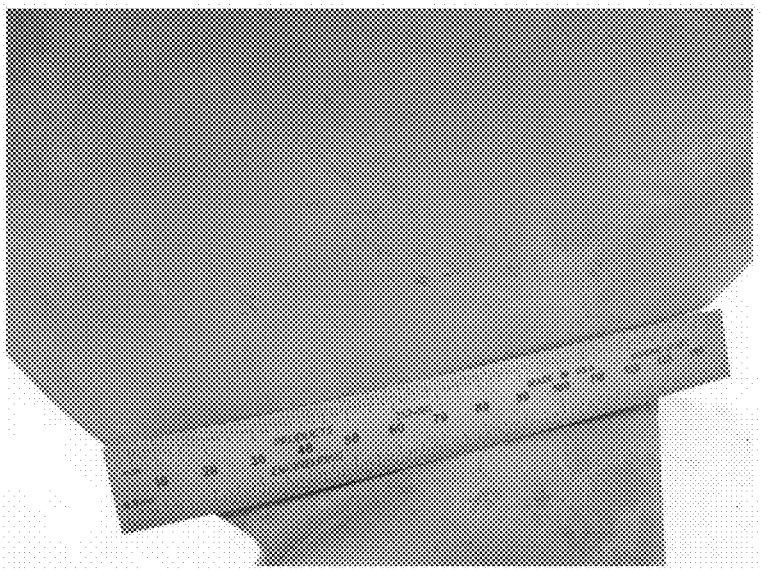
Figure 4C:
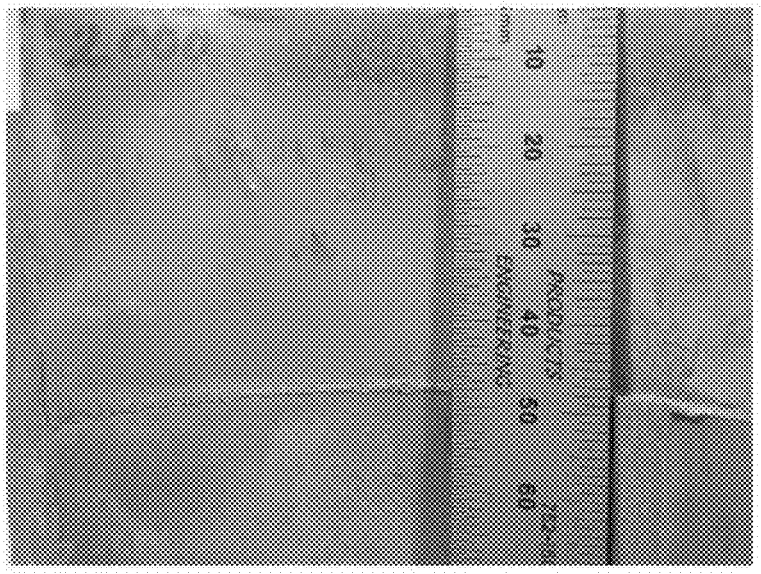
Figure 5A:
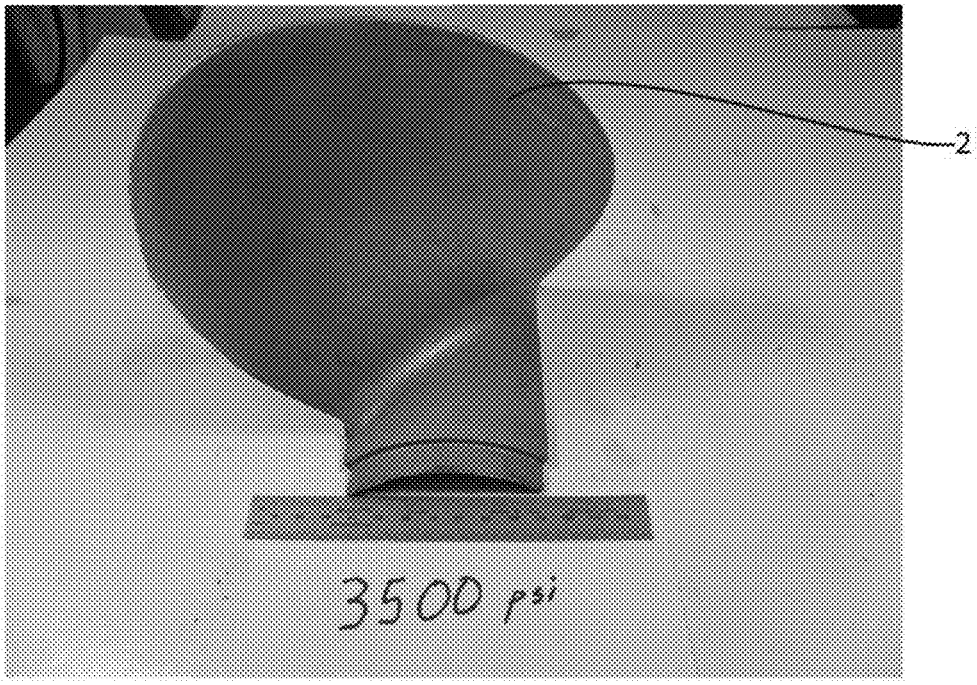
FIGS. 5*a* and 5*b* are photographs of a solution heat treated high pressure die cast aluminum alloy propeller blade demonstrating elimination of blistering defects when 3.5 KSI (3500 psi) of pressure is applied during solution heat treatment.
Figure 5B:
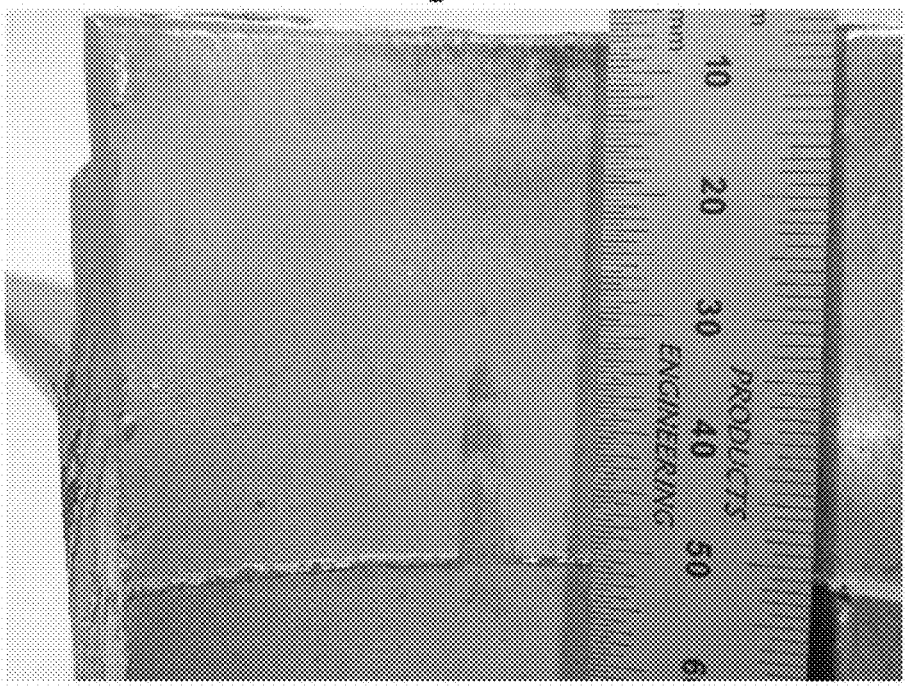

High pressure die cast aluminum alloy marine propellers were subjected to solution heat treatment with pressure. Three (3) high pressure die cast aluminum alloy marine propellers were each solution heat treated at 3.5 KSI, 2.0 KSI, and 0.5 KSI at 1000° F. for 4 hours. The three propellers solution heat treated at 3.5 KSI demonstrated an elimination of blistering defects as shown in FIG. 5. The three high pressure die cast aluminum alloy marine propellers solution heat treated at 0.5 KSI demonstrated a reduction of blistering defects as shown in FIG. 3. The three high pressure die cast aluminum alloy marine propellers solution heat treated at 2.0 KSI demonstrated a significant reduction of blistering, with one small blister on only 1 of 3 propeller blades, as shown in FIG. 4.

Accordingly, the experiments confirm solution heat treatment with pressures between 0.5 and 35.0 KSI result in reduction of blister defects on high pressure die cast aluminum marine propellers, and pressures between 3.5 and 15.0 KSI demonstrate an elimination of blistering defects in high pressure die cast aluminum alloy marine propellers.

Example 3

Figure 9A:
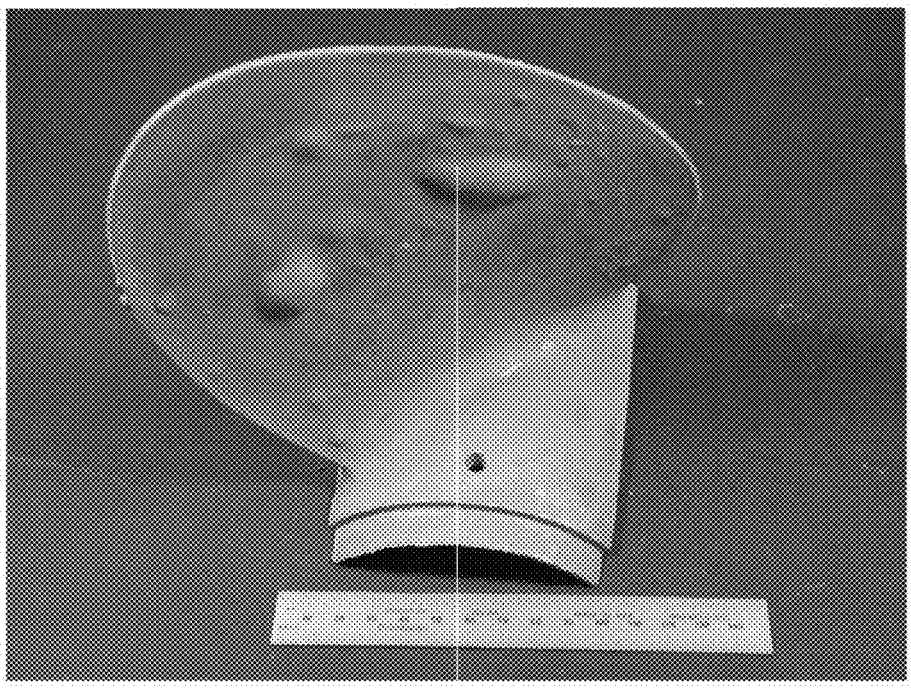
FIGS. 9*a* and 9*b* are photographs of a high pressure die cast aluminum alloy propeller blade treated by hot isostatic processing (HIP) and subsequently solution heat treated with no pressure.
Figure 9B:
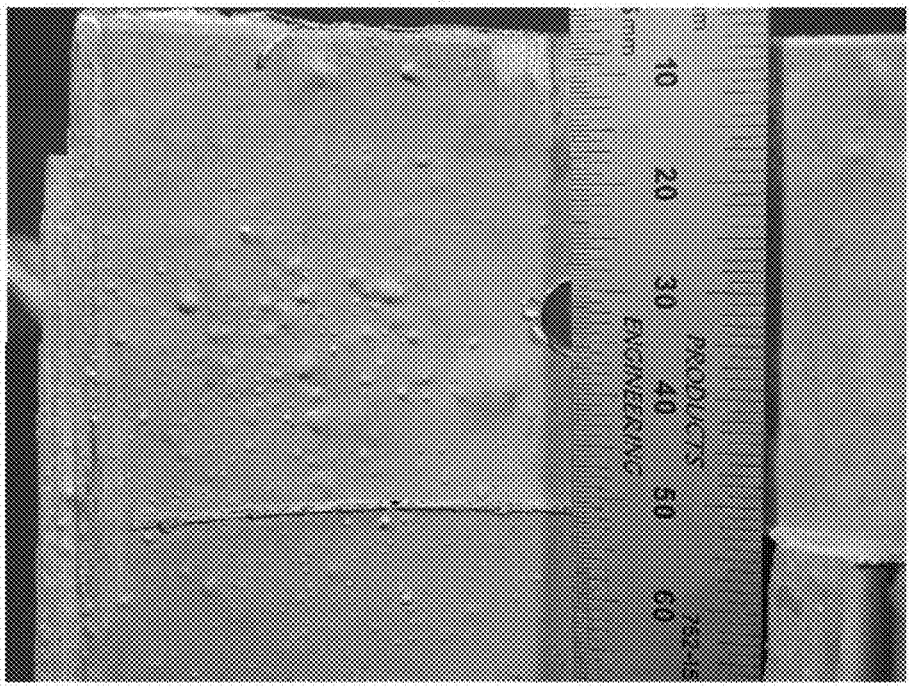

The lack of effectiveness of HIP processing on high pressure die castings was verified by the inventors in an experiment where a high pressure die cast propeller was subjected to 15 KSI pressure at 1000° F. for 4 hours of hot isostatic pressing and allowed to cool to room temperature. The same propeller was then heat treated at 1000 F for 4 hours at atmospheric conditions. Blistering defects were still evident after the process showing that the internal defects in the casting were not healed by the HIP process as shown in FIGS. 9A and 9B.

Example 4

Figure 10A:
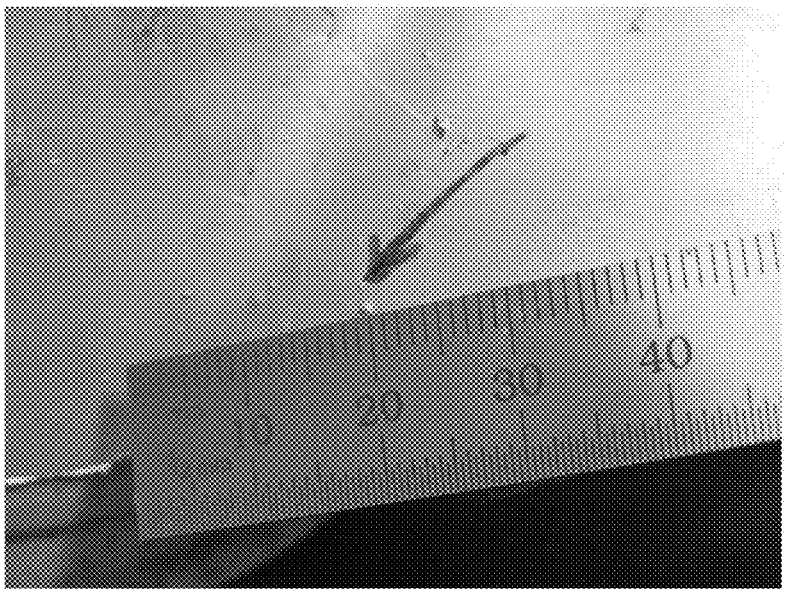
FIGS. 10*a* and 10*b* are photographs of a high pressure die-cast aluminum alloy propeller blade treated with 2.3 KSI of pressure during solution heat treatment.
Figure 10B:
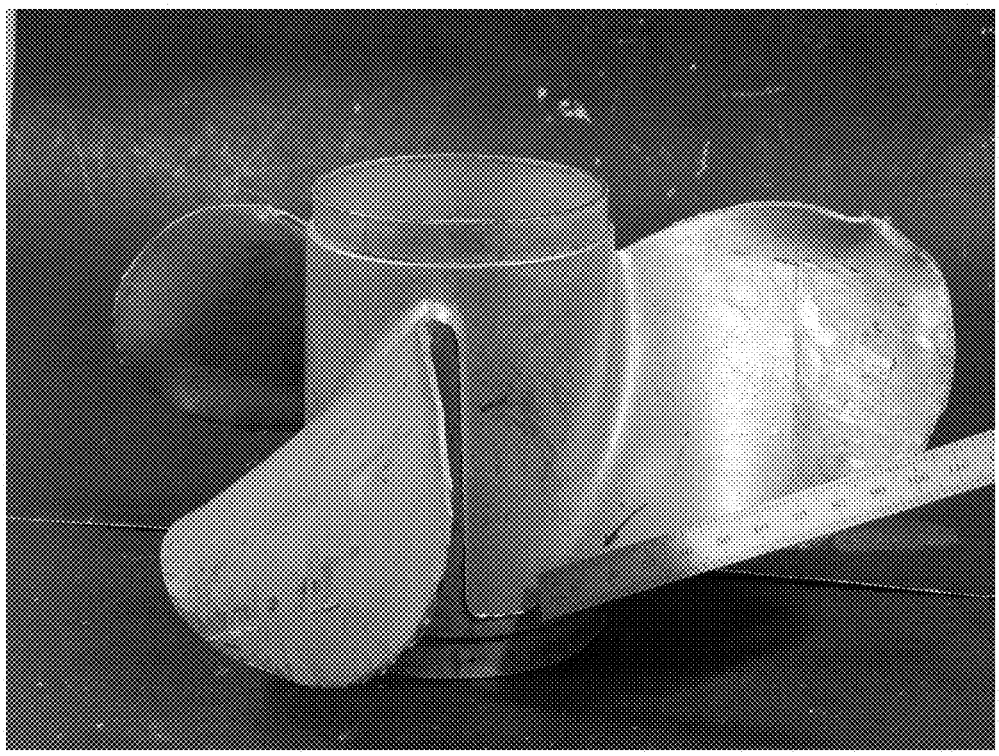

In an effort to more accurately define the lowest pressure at which blistering will not occur, two (2) high pressure die cast aluminum alloy marine propellers each having three (3) blades were each solution heat treated at 2.5 and 2.3 ksi at 1000 F for 4 hours. The 3-blade propeller solution heat treated at 2.5 ksi demonstrated a total elimination of blistering defects. In contrast, the 3-blade high pressure die cast aluminum alloy marine propeller solution heat treated at 2.3 ksi also demonstrated a significant reduction in blistering, bit did demonstrated one small blister at the root of one of the propeller blades. The diameter of this blister is approximately 1 mm in diameter, as shown in FIG. 10*a*. The propeller was subjected to a drop weight impact test to ascertain whether the blister reduced the mechanical ductility of the propeller blade. As shown in FIG. 2, the propeller processed at 2.3 ksi after a drop weight impact test showing the very small blister did not substantially reduce ductility or result in fracture of the blade. However, because one (1) very small blister was detected on one (1) blade at 2.3 ksi, the lower pressure limit where the invention can be expected to be reliably practiced without any blistering is 2.5 ksi.

The highest pressure limit where both blistering will not occur and the invention has utility is not defined by the blistering mechanism itself. Pressures equal to 2.5 ksi and up to 35 ksi have been demonstrated to eliminate blistering. Instead, the upper limit of pressure where the invention has practical utility is defined by the increasing equipment cost of the pressure vessel and increasing process cycle time that adds to the final product cost. As pressure increases, both the capital cost of the pressure vessel itself increases and the process cycle time and associated cost increases on a non-linear basis. When these capital and process cycle time costs become excessive, it is not financially advantageous to use high pressure diecast articles and the inventive processing method. Instead, other metalworking or casting processes, such as but not limited to forging a wrought blank and machining or ablation casting become more financially preferred. The upper pressure limit of 15 ksi is defined by the capital equipment and process costs of today's modern pressure vessel technology.

In the above description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. § 112(f) only when the terms "means for" or "step for" are explicitly recited in the respective limitation. While each of the method claims includes a specific series of steps for accomplishing the claimed method, the scope of this disclosure is not intended to be bound by the literal order or literal content of steps described herein, and not substantial differences or changes still fall within the scope of the disclosure.

What is claimed is:

1. A method of heat treating a high pressure die cast aluminum alloy object, the method comprising: obtaining a high pressure die cast aluminum alloy object; and solution heat treating the high pressure die cast aluminum alloy object above 700° F. while applying pressure between 2.5 and 10 KSI for 2 to 8 hours in a solution heat treatment vessel, and quenching the high pressure die cast aluminum alloy object after removing the object from the solution heat treatment vessel; wherein the step of solution heat treating eliminates blistering defects on the high pressure die cast.

2. The method of claim 1 wherein the step of solution heat treating comprises applying pressure between 2.5 and 5 KSI and the method further comprises subsequently quenching the cast object and artificially aging the cast object to effect a T6 heat treatment.

3. The method of claim 1 wherein the step of solution heat treating comprises solution heat treating the high pressure die cast object between 700° F. and 1200° F.

4. The method of claim 1 wherein the step of solution heat treating comprises solution heat treating the high pressure die cast object at 1000° F.

5. The method of claim 1 wherein the step of solution heat treating comprises applying pressure between 2.5 and 5 KSI, and wherein the step of solution heat treating eliminates blistering defects on the high pressure die cast object.

6. The method of claim 1 wherein the step of solution heat treating comprises solution heat treating the high pressure die cast object for 4 to 6 hours.

7. The method of claim 1 wherein the method of heat treating further comprises the step of artificially aging the high pressure die cast object.

8. A method of heat treating a high pressure die cast aluminum alloy object, the method comprising: casting an aluminum alloy object with high pressure die casting equipment; removing the cast aluminum alloy object from the high pressure die casting equipment; placing the cast aluminum alloy object into a pressure vessel, the pressure vessel including a heating element; solution heat treating the cast aluminum alloy object above 700° F. while applying pressure between 2.5 and 10 KSI for 2 to 8 hours; removing the cast object from the pressure vessel; and quenching the die cast aluminum alloy object after removing the object from the pressure vessel, wherein the step of solution heat treating reduces blistering defects on the die cast aluminum alloy object.

9. The method of claim 8 wherein the step of solution heat treating comprises applying pressure between 2.5 and 5 KSI and the method further comprises subsequently quenching the cast object and artificially aging the cast object to effect a T6 heat treatment.

10. The method of claim 8 wherein the step of solution heat treating comprises solution heat treating the cast aluminum alloy object between 700° F. and 1200° F.

11. The method of claim 8 wherein the step of solution heat treating comprises solution heat treating the cast aluminum alloy object at 1000° F.

12. The method of claim 8 wherein the step of solution heat treating comprises applying pressure between 2.5 and 5 KSI, and wherein the step of solution heat treating eliminates blistering defects on the die cast aluminum alloy object.

13. The method of claim 8 wherein the step of solution heat treating comprises solution heat treating the cast aluminum alloy object for 4 to 6 hours.

14. The method of claim 8 wherein the method of heat treating further comprises the step of artificially aging the cast aluminum alloy object.

* * * * *